US006725759B1

(12) United States Patent
Kathe et al.

(10) Patent No.: US 6,725,759 B1
(45) Date of Patent: Apr. 27, 2004

(54) INTEGRAL CONTAINMENT ELECTROMAGNETIC GUN

(75) Inventors: Eric L. Kathe, Ballston Lake, NY (US); Michael J. Glennon, Loudonville, NY (US); Michael D. Gully, Waterford, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/249,662

(22) Filed: Apr. 29, 2003

(51) Int. Cl.[7] ..... F41F 1/00
(52) U.S. Cl. ..... 89/8; 89/14.05; 124/3
(58) Field of Search ..... 89/8; 124/3

(56) References Cited

U.S. PATENT DOCUMENTS 4,624,173 A * 11/1986 Creedon ..... 89/8
4,681,015 A * 7/1987 Creedon ..... 89/8
4,840,200 A * 6/1989 Creedon ..... 138/172
4,846,911 A * 7/1989 Tackett et al. ..... 156/173
5,076,135 A * 12/1991 Hurn et al. ..... 89/8
5,454,289 A * 10/1995 Bacon et al. ..... 89/8

* cited by examiner

*Primary Examiner*—Michael J. Carone
*Assistant Examiner*—M. Thomson
(74) *Attorney, Agent, or Firm*—Michael C. Sachs; John F. Moran

(57) ABSTRACT

Methods and apparatus related to design and construction of lightweight and mobile rail gun barrels. The barrels comprise a pair of elongated, generally parallel conductive rails extending along opposite sides of the bore and being symmetrical about a longitudinal axis of the bore; a pair of elongated insulators disposed generally coextensively with the rails and circumferentially between them and maintained in a compressed state; a circumferentially sleeve surrounding the insulators; a plurality of Belleville containment disk maintained in a stack that are compressed and surround the circumferential sleeve, each containment disk having a substantially hollow form with an outer surface, and an inner surface; and a plurality of longitudinal tension rods, disposed substantially parallel to the longitudinal axis of they bore and disposed external to the sleeve, the tension rods compress the plurality of Belleville containment disk. A protective sleeve and cooling channels can form part of the barrel.

7 Claims, 6 Drawing Sheets

INTEGRAL CONTAINMENT ELECTROMAGNETIC GUN

FEDERAL RESEARCH STATEMENT

The invention described herein may be manufactured, used or licensed by or for U.S. Government purposes without the payment of royalties thereon.

BACKGROUND OF INVENTION

I. Field of Invention

This invention applies to the field of rail guns and more particularly, to a barrel assembly in an electromagnetic rail gun.

II. Background of the Invention.

Challenges presented by rail gun construction have existed since the early 1920s. Examples of such guns are taught in U.S. Pat. Nos. 1,370,200; 1,421,435; and 1,422,427. Current laminated-type rail gun barrels 10 for applications requiring light weight mobile use typically comprise stacked metallic annular or rectangular laminations in combination with pre-stressed tension elements to add radial and longitudinal stiffness. These laminations 11 have engineered shapes (often an elongated annular shape) to accommodate a plurality of longitudinal rails 12 within the barrel 10, and the lamination shape is optimized to contain radial forces (tending to spread the rails 12) associated with the launching of rail gun projectiles.

Longitudinal stiffness of a rail gun barrel 10 can be obtained from tension elements 13 that may be spirally wound around the barrel at a preferred angle with the barrel longitudinal axis as taught in U.S. Pat. No. 5,454,28? entitled "Lightweight High L" Electromagnetic Launcher." Alternatively, axial tension rods 14 may be used to preload the metallic laminates 11 in compression as shown in FIG. 1 (Prior Art), to provide a high effective bending modulus, provided the preload is not defeated by disturbance loads, Ref. "A High Performance Rail Gun Launcher Design," Juston, John M. and Bauer, David P., IEEE Trans Mag., v33n1, pp. 566–570, Jan. 1997.

Radial stiffness of a rail gun barrel 10 is required in order to contain the rails 12 of the gun. In strong analogy with gas propulsion guns, the electromagnetic forces that propel the projectile out of a rail gun, also apply substantial loads to drive the rails 12 apart. The resulting strain of the rails 12 under the imposed magnetic stress may impair performance of the launcher as it propels projectiles at velocities in excess of 2/km/s. Since the rails 12 must be electrically insulated from each other, current practice is to place an insulator 15 between the two rails 12. Since it is most challenging to engineer a structure that would allow the insulator material 15 to both bind to the rails, and to provide stiffness in tension, high performance rail gun designs incorporate a substantial compressive preload of the rails 12 against the insulator 15 that separates them. Using this approach, the modulus of the insulator 15 (often a ceramic), may contribute to reducing the dynamic strains of the rails 12 during operation, as long as the stresses do not exceed the preload magnitude. This is in complete analogy with any engineered tension compression system including tires and pre-stressed concrete.

Two methods of achieving this desirable pre-stress are depicted in FIGS. 2A (PRIOR ART) and 2B (PRIOR ART). In FIG. 2A (PRIOR ART), a wedge 16 is driven between a split insulator 15 after the rail gun assembly has been undertaken. In FIG. 2B (PRIOR ART), a "flatjack" 18 is assembled between the main rails 12 and outer tensile containments structure 11. After assembly, the "flatjack" 18 is pressurized with epoxy driving the rails 12 inward against the insulator (ceramic sidewall 19) while pulling the composite overwrap 20 out in tension. The epoxy subsequently cures to a solid state, making the pre-stress permanent.

Active cooling channels 21 are also generally required for heat dissipation in rail guns due to the very high ohmic heat loss effects which are on the order of twenty times more heat input to the launcher than a traditional gas gun. Thus active cooling channels 21 are desirable. In the design shown in FIG. 2B, active cooling channels 21 are integrated directly with the conducting rails 12, see "Cannon-Caliber Electromagnetic Launcher, " Zielinski, Alex E. and Werst, M. D. . IEEE Trans Mag, v33n1, pp. 630–635, Jan. 1997. With the design shown in FIG. 2A, conduction of the heat from the rails 12 through the containment structure 11 is sought to later dissipate the heat to the environment through the outer layer of the barrel 10. Both of these approaches have limited success due to the fact of the small heat capacity of the surrounding air, and the low surface area of the outer skin of these types of rail designs.

To date, there is a need in this art for robust structural components in a rail gun, wherein these components can be preloaded to provide adequate pre-stressing of the containment structure for applications requiring light-weight mobile use.

Accordingly, it is an object of this invention to provide an improved containment barrel for a rail gun that enables increased muzzle energy and accuracy of a projectile.

Another object of this invention is to provide a design for a rail gun, wherein the barrel incorporates desired preload stresses in the gun containment structures.

Another object is to provide a design for a rail gun, wherein location of the cooling channels are in an area of low structural strain to provide active cooling of the rail gun, yet impart minimal impact to a rail gun design.

Finally another object of this invention is to substantially overcome the shortcomings in prior rail gun barrels and methods for making them, relating particularly to rail guns which are sufficiently strong, lightweight and stiff for mobile applications.

SUMMARY OF INVENTION

It has now been discovered that the above and other objects of the present invention may be accomplished by the following mechanism and in the following manner.

The rail gun barrel of the present invention comprises a pair of elongated, generally parallel conductive rails extending along opposite sides of the bore and being symmetrical about a longitudinal axis of the bore; a pair of elongated insulators disposed generally coextensively with the rails and circumferentially between them and maintained in a compressed state; a circumferential sleeve surrounding the insulators; a plurality of Belleville containment disks maintained in a stack that are compressed and surround the circumferential sleeve, each containment disk having a substantially hollow form with an outer surface, and an inner surface; and a plurality of longitudinal tension rods, disposed substantially parallel to the longitudinal axis of the bore and disposed external to the sleeve, the tension rods compresses the plurality of Belville containment disks.

BRIEF DESCRIPTION OF DRAWINGS

The features of the present invention and the manner of attaining them will become apparent, and the invention itself will be understood by reference to the following description and the accompanying drawings. In these drawings, like numerals refer to the same or similar elements. The sizes of the different components in the figures might not be in exact proportion and are shown for visual clarity and for the purpose of explanation.

DETAILED DESCRIPTION

Figure 1:
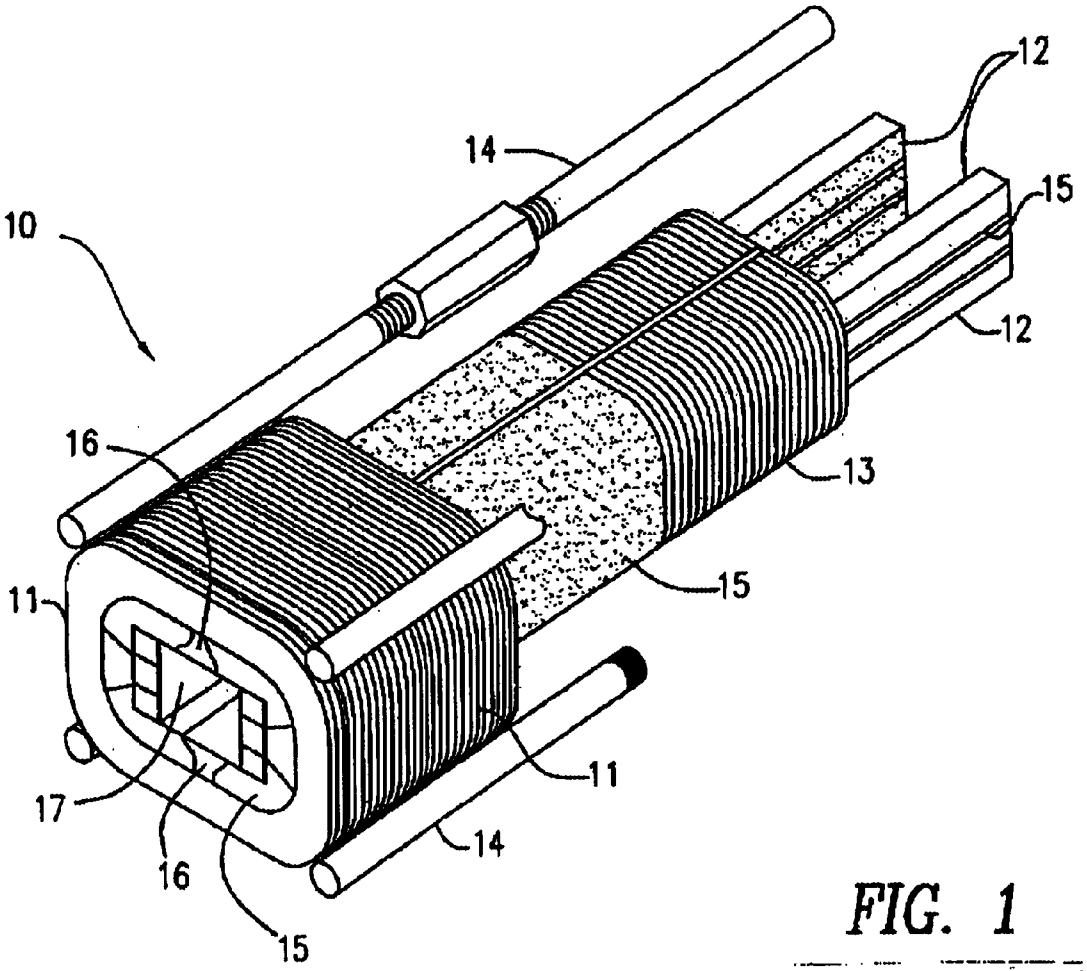
FIG. 1 (PRIOR ART)
FIG. 1 (PRIOR ART) is a diagrammatic perspective view of a laminated rail gun containment structure.

During firing of a cylindrical gas-type gun as in FIG. 1, such a gun exhibits peak stresses at the bore 17. A radial compressive stress, sigma r, results as the bore 17 is prevented from being pushed out by the outer wall of the barrel. In addition, a tangential or "hoop" stress, sigma t, is formed as the bore 17 resists enlargement itself. Neglecting the axial tension load of recoil as it is small, these two principal stresses combine to form the equivalent (von Mises) stress, sigma e, shown in FIG. 3A. A uniform stress distribution over the entire tube cross section during firing can be attained by means of autofrettage, see "Guns," Horn, F., in "Handbook on Weaponry," Second Edition Ed., Rheinmetall Gmbh.Dusseldorf, 1982.

Figure 3D:
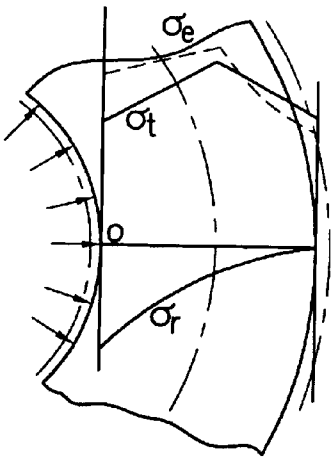
FIGS. 3A, 3B, 3C, and 3D are plots of internal stresses of a cylindrical gun barrel as a function of radius for (a) normal gun firing, (b) during autofrettage, (c) after autofrettage, and (d) autofrettage gun during firing respectively.
Figure 3C:
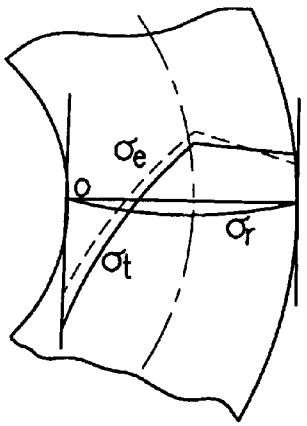
Figure 3B:
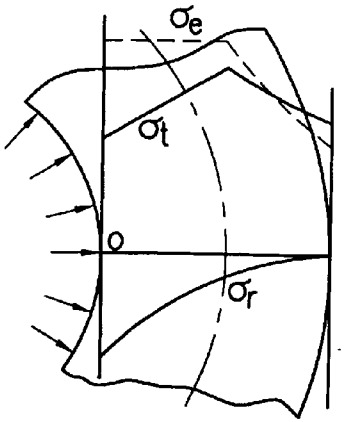
Figure 3A:
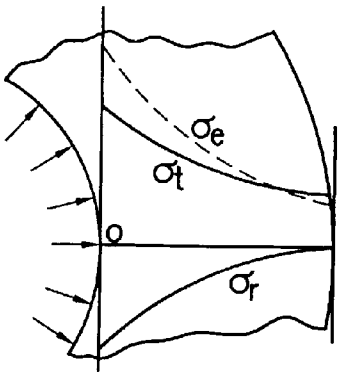

Autofrettage is the process of pre-stressing traditional high pressure guns by applying an internal pressure sufficient to cause a plastic radial dilation of the bore. As high pressure guns are thick walled pressure vessels, the strain imposed by the autofrettage pressure may result in decreasing levels of plastic deformation at outer radial portions of the wall. Typically, the autofrettage pressure results in strains that are insufficient to cause plastic deformation of the outer hoop layers of the gun barrel. FIG. 3B depicts that once the material begins plastic deformation, the stress no longer increases, the equivalent stress flat-lines in the plastic zone during autofrettage. Once the autofrettage pressure is relieved, the outer hoop layers are left in a state of tension as they attempt to drive the permanently enlarged bore hoop layers back to their original size. FIG. 3C shows the results that being in the compression of the surface of the bore. Upon firing, a nearly constant equivalent stress is achieved through out the radius of the gun barrel. The propulsion pressure overcomes the compression preload gun as shown in FIG. 3D.

Figure 2B:
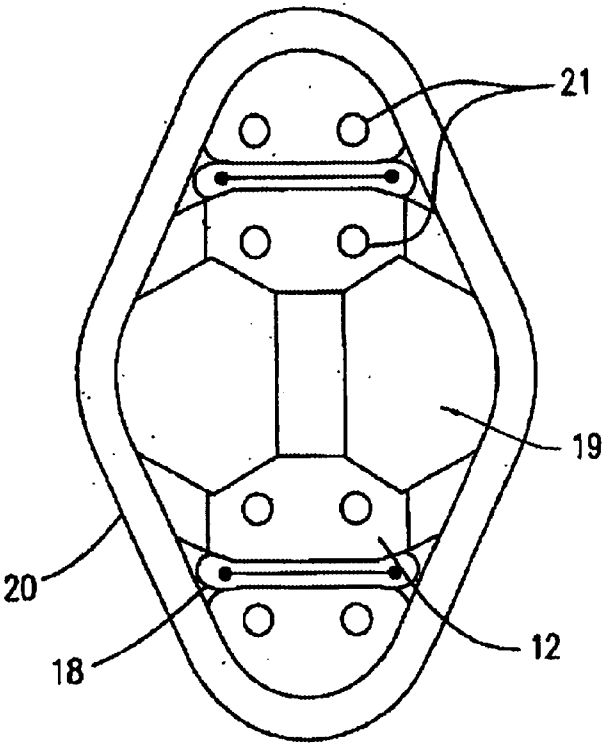
FIG. 2B (PRIOR ART)
FIG. 2A and 2B (PRIOR ART) are transverse sectional views of a containment structure using laminated steel and composite overwrap methods.
Figure 2A:
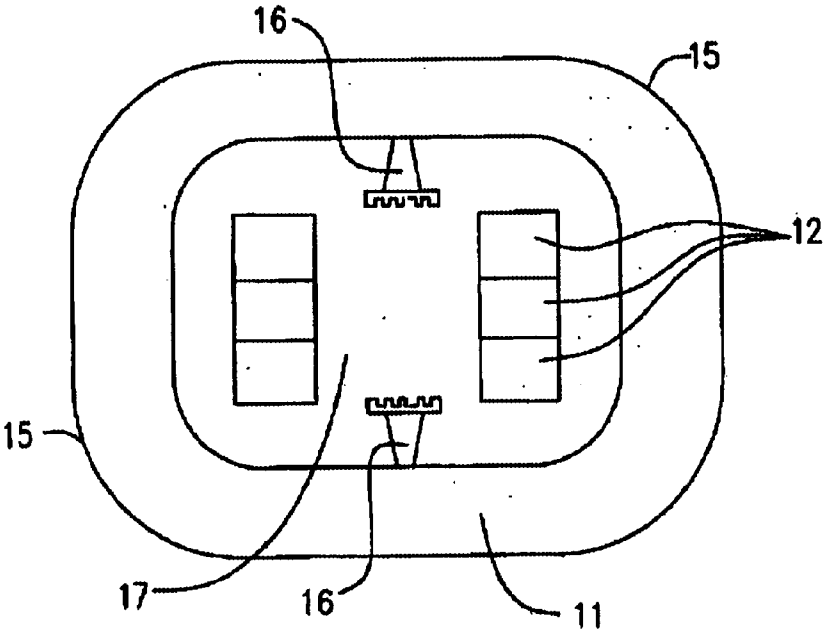
FIG. 2A (PRIOR ART)

Autofrettage is distinct from the current pre-stressed rail gun construction as typified by the designs shown in FIGS. 2*a* and 2*b* (PRIOR ART). First, the bore 17 of the gas gun (typically constructed of steel) is fully capable of tolerating substantial tension. This is in sharp contrast to the insulators 15 of the rail guns that must be bound in compression to prevent separation of the rails 12 from the insulator 15. Second, autofrettage achieves a favorable stress distribution throughout the structure. The outer tensile containment structure of these rail guns exhibits the highest strain at the inner layers of the tensile containment structure.

Using principles presented by autofrettage in gun construction as discussed above, it has been discovered -that modified designs of rail guns can incorporate principles of this phenomenon. The present invention, embodying a rail gun barrel defined by an elongated bore 31 shown at FIG. 4 for passage of a projectile, is explained as follows.

Figure 4:
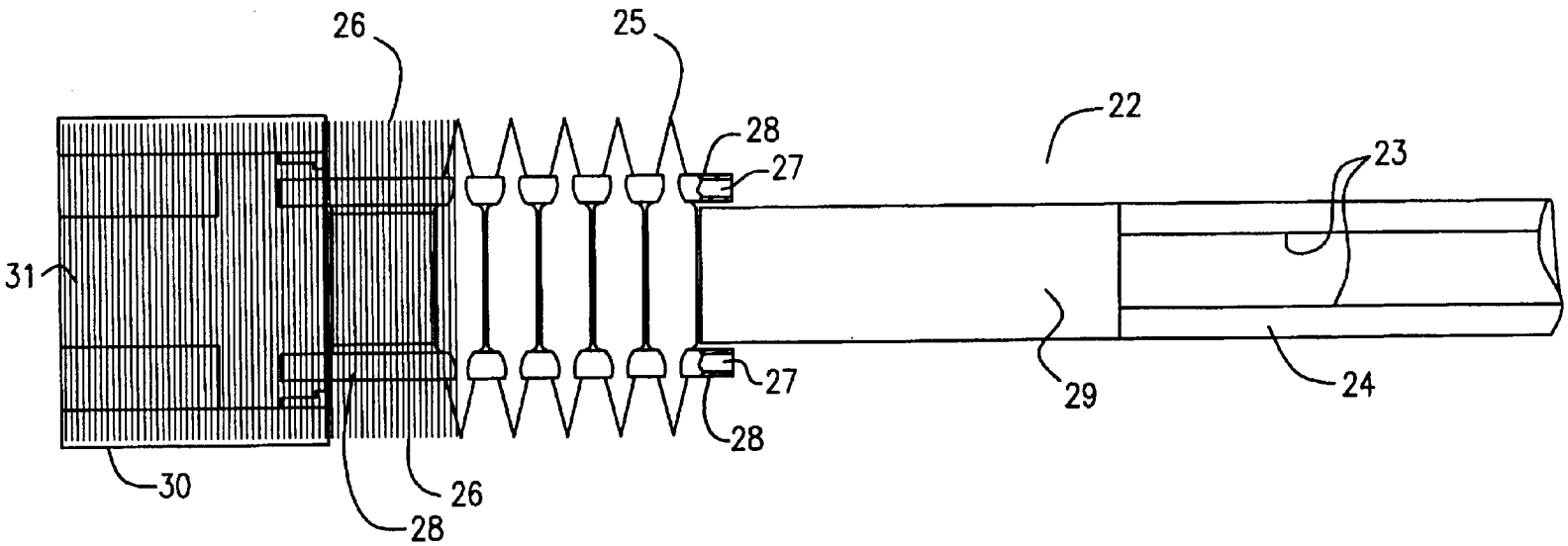
FIG. 4 shows a longitudinal sectional view of a barrel in accordance with the invention.
Figure 5:
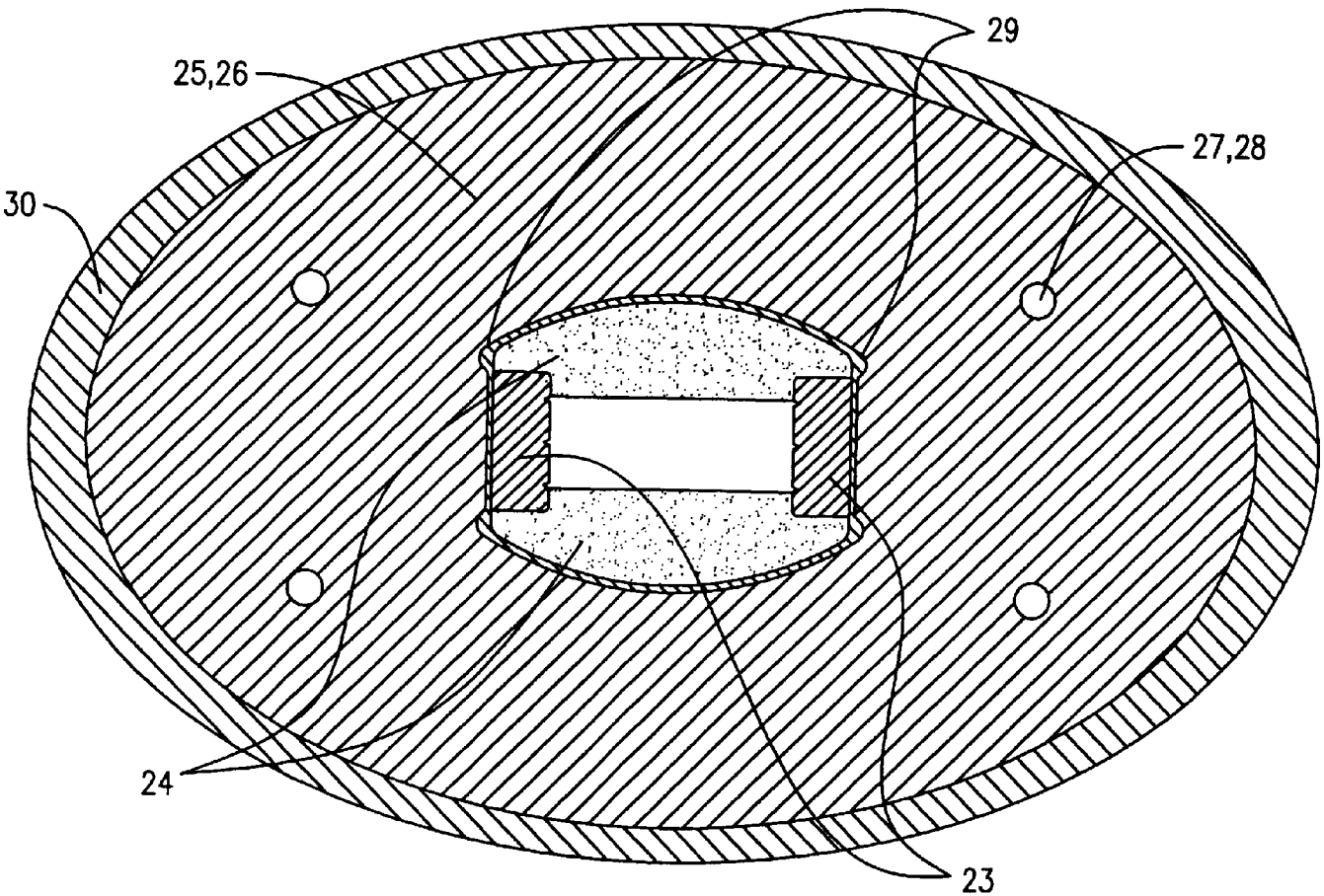
FIG. 5 is a transverse sectional view a—a of the barrel shown in FIG. 4.
Figure 6A:
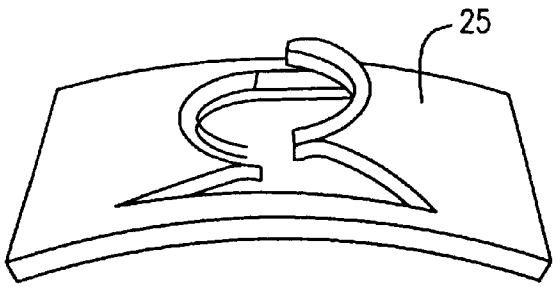
FIGS. 6A, 6B, 6C, and 6D show alternative forms of the Belleville effect disk that can be used by the invention.
Figure 6B:
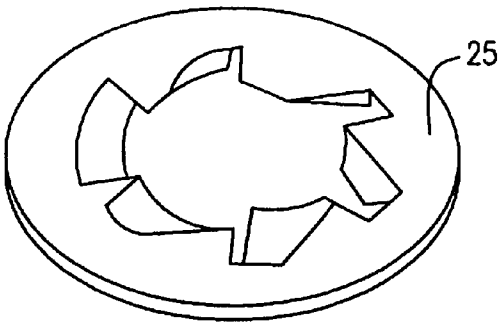
Figure 6C:
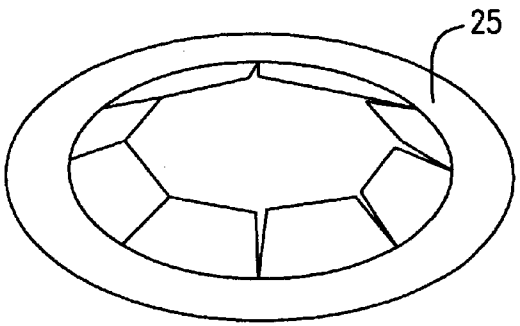
Figure 6D:
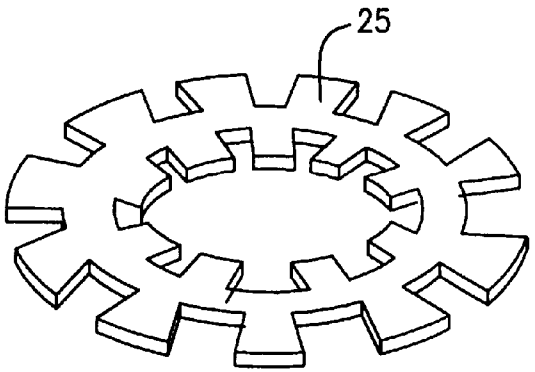

FIGS. 4 and 5 depict a preferred rail gun barrel 22 construction which comprises a pair of elongated, generally parallel, electrically conductive rails 23 and a pair of elongated generally parallel insulators 24. FIG. 4 shows the gun wherein Belleville containment disk 25 are in a non-compressed state and in a compressed disk 26 when assembled. The insulators 24 are disposed circumferentially between the rails 23. That is the rails 23 and insulators 24 are disposed alternately about the circumference of the barrel so that the rails 23 do not contact one another. The rails 23 are preferably made of a copper alloy. The compressed insulators 24 herein are made of a ceramic material. The rails 23 are disposed symmetrically about the longitudinal axis of the barrel, as are the insulators 24. Each rail 23 has a pair of generally planar side surfaces that abut generally side surfaces of the insulators 24 at interfaces that define radial planes. The rails 23 are electrically connected at their respective rearward or breech ends to opposite terminals of a source of direct current(not shown).Means for loading projectiles into the barrel 22 are provided at the breech end.

The rails 23 preferably have cooling passages 27 adjacent to them for coolant flow. These cooling passages are located in an area of low structural strain so as to provide active cooling of the rail gun 22. These passages contained within the compressed containment disks 25,26 after assembly enable liquid coolant to effect heat transfer from the compressed containment disks 26 to an external heat exchanger (not shown). The location for these cooling passages 27 are symmetrically disposed about the barrel 22 with the axial tension rods 28.

The rails 23 and insulators 24 herein define a substantially cylindrical bore 31 through which the projectile (not shown) travels. More specifically, the rails 23 and insulators 24 have curved inner surfaces that collectively define the substantially cylindrical bore 31. The bore may be of circular or may alternatively be of rectangular or other suitable cross section.

The rails 23 and insulators 24 are contained within a circumferential insulator sleeve 29 that prevents current flow from rails 23 from passing through containment disks 26. This sleeve 29 also provides adequate lubrication to enable the Belleville effect containment disk 25 to be compressed during manufacture.

A circuit through the rails 23 may be completed either by a conductor or a plasma arc disposed between the rails 23. Where a plasma arc is used, high fluid pressures are generated within the bore 31 by vaporization of a strip of metal. As current flows through the circuit, magnetic flux is generated between the rails 23. The magnetic flux cooperates with the current in the conductor or plasma arc to accelerate the conductor or plasma forward between the rails 23. The projectile may include the conductor or may be positioned forward of the conductor or plasma arc and driven forward thereby.

When the rail gun is fired, bursting forces resulting from the interaction of the current in the rails 23 with the magnetic flux generated thereby urge the rails 23, outwardly. In addition, where a plasma arc is present within the bore, high fluid pressures urge both the rails 23 and insulators 24 radially outward.

The bursting forces are not uniform along the length of the barrel 22, but rather act only on the portion of the barrel 22 behind the projectile. Thus, at any point in time during firing, each of the internal barrel components 23,24 has a highly stressed region behind the projectile and a less stressed region ahead of the projectile.

A circumferential insulator sleeve 29 prevents the rails 23 and insulators 24 from being displaced radially outward, but it has been found that the inner surfaces of the rails 23 and insulators 24 may be displaced outward by compression of these components. The sleeve provides a thin electrically insulating layer to prevent current flow from the rails 23 from passing through the compressed containment disks 26. This also functions to provide adequate lubrication to enable the Belleville effect containment disks 25 to become compressed containment disks 26 during the assembly of the rail gun barrel.

The above described stress pattern thus may instantaneously compress rearward portions of the rails 23 and insulators 24 more than forward portions thereof, generating bending moments along the inner surfaces of the rails 23 and insulators 24 which define the bore 31. The tensile stresses attendant to the bending moments in the rails 23 are generally not of sufficient magnitude to damage the rails 23, but those in the insulators 24, which are preferably made of a ceramic material having very good electrical insulating properties, may cause cracking because such ceramic materials typically have low tensile strength and are relatively brittle.

In accordance with the invention, the insulators 24 are pre-stressed axially so that bursting forces acting thereon during firing which could otherwise produce axial tensile stresses near the inner surfaces thereof instead simply diminish the magnitude of the axial compressive stresses near the inner surfaces. Axial compressive pre-stressing of the insulators 24 maintain spacing of rails 23.

Axial tension rods 28, which can be hollow, are used to compress the Belleville effect containment disks 25 from their relaxed state to a compressed state shown as disk 26 after assembly of the rail gun barrel 22. These rods 28 provide sufficient axial preload to achieve high bending modulus, as described above.

The Belleville effect containment disk (25-unassembled and 26-after assembly) are laminated containment plates. Laminations (disk) 25, 26 are typically required to reduce unwanted eddy currents when the gun is fired. The disk 25, 26 have an out-of-plane distortion that minimizes this eddy current effect. The Belleville effect containment disk 25, 26, having characteristics similar to Belleville washers, thereby enabling improved flexibility in the control of preloads that result within the structure when compressed. These disk may also include perforations to induce discontinuous strain distributions upon their compression. For example, inward facing fingers that are deflected upwards out of plane. FIGS. 6A–D depict various Belleville containment effect disk designs that can be used in this invention.

When the Belleville effect containment disk 26 are compressed, the non-compressed disk 25 are subject to axial compression sufficient to defeat any out of plane distortion. As in the case of Belleville washers, as long as the disks 26, 27 are assembled with alternating out of plane deformations, the net load required to prevent distortion is the same for either on one disk or as may as a hundred disks. This is due to the fact of an additive superposition of each disk spring effect, as opposed to a parallel addition effects that occurs if the deformations were not alternating. As the disks 25 are compressed, the strain of defeating the out of plane deformations results in stress distributions that vary with both radius and azimuth imposed throughout the laminate. Depending upon the magnitude of deformation of the Belleville effect containment disks 25, 26, plastic deformation can be achieved, if desired. Using FIG. 5, for most configurations, the accompanying radial and azimuthal strain will tend to contract the bore of the laminate, applying a compressive preload through the circumferential insulator sleeve 29 and rails 23 and compressed insulators 24.

For preferred packaging of the gun, FIG. 5 shows a wrapping shroud 30 which provides environmental protection, additional bending stiffness if required, thermal insulation from uneven heating sources, and for minimizing electromagnetic signature emanation for stealth use in the field.

Other types of Belleville effect containment disk 25 prior to compression during assembly of the barrel may be used to achieve discontinuous changes in pre-strain. For example, these disks 25 can include perforations as shown in FIGS. 6A, 6B, 6C, and 6D, which are generally referred to as rectangular speed nuts, push nuts for screws and studs, and external-internal respectfully.

From the foregoing, it will be appreciated that the invention provides an improved rail gun barrel and an improved method of manufacturing rail gun barrels. However, the embodiments described herein are included for the purposes of illustration, and are not intended to be exclusive; rather, they can be modified within the scope of the invention. Other modifications may be made when implementing the invention for a particular application.

What is claimed is:

1. A rail gun barrel defining an elongated bore, the barrel comprising:

a pair of elongated, generally parallel conductive rails extending along opposite sides of the bore and being symmetrical about a longitudinal axis of the bore;

a pair of elongated insulators disposed generally co-extensively with the said rails and circumferentially between them and maintained in a compressed state;

a circumferential sleeve surrounding the said insulators;

a plurality of Belleville containment disk maintained in a stack that are compressed and non-compressed and surround the circumferential sleeve, each containment disk having a substantially hollow form with an outer surface, and an inner surface; and a plurality of longitudinal tension rods, disposed substantially parallel to the longitudinal axis of the bore and disposed external to the sleeve, the tension rods compress the plurality of Belleville containment disk.

2. The rail gun barrel according to claim 1, wherein the tension rods pass through each of the Belleville containment disk.

3. The rail gun barrel according to claim 1, further including at least one cooling tube member disposed external to the sleeve member and along the longitudinal axis of the bore, with at least one cooling tube passing through each of the Belleville containment disk.

4. The rail gun barrel according to claim 1, further including a shroud member that surrounds the outer edges of the Beliville containment disk.

5. The rail gun barrel according to claim 1, wherein each of the Belleville containment disk has a rectangular speed nut form.

6. The rail gun barrel according to claim 1, wherein each of the Belleville containment disk has a push nut form.

7. The rail gun barrel according to claim 1, wherein each of the Belleville containment disk has an external-internal speed nut form.

* * * * *